United States Patent [19]

Andrew et al.

[11] 4,227,862

[45] Oct. 14, 1980

[54] SOLID STATE COMPRESSOR CONTROL SYSTEM

[75] Inventors: Eduardo V. Andrew, Liverpool, N.Y.; Robert A. Naunas, Jr., Fairfield, Pa.; Richard C. Armstrong, Jr., Inwood, W. Va.

[73] Assignee: Frick Company, Waynesboro, Pa.

[21] Appl. No.: 943,887

[22] Filed: Sep. 19, 1978

[51] Int. Cl.[3] ..... F04B 49/06; F04B 49/02; F04B 49/10

[52] U.S. Cl. ..... 417/12; 417/13; 417/18; 417/19

[58] Field of Search ..... 417/12, 13, 18, 19, 417/21, 26, 27

[56] References Cited

U.S. PATENT DOCUMENTS

| | | | |
|---|---|---|---|
| 2,613,026 | 10/1952 | Banks | 417/305 |
| 3,007,414 | 11/1961 | Long et al. | 417/28 |
| 3,088,655 | 5/1963 | Miller | 417/14 |
| 3,232,519 | 2/1966 | Long | 417/13 |
| 3,291,146 | 12/1966 | Walker | 415/15 |
| 3,332,605 | 7/1967 | Huesgen | 415/27 |
| 3,478,731 | 11/1969 | Morton | 417/13 |
| 3,535,053 | 10/1970 | Jednacz | 417/18 |
| 3,673,811 | 7/1972 | Adams et al. | 417/13 |
| 3,743,442 | 7/1973 | Wilson | 417/12 |
| 3,934,238 | 1/1976 | Pavlou | 340/239 |
| 3,957,395 | 5/1976 | Ensign | 417/28 |
| 3,961,862 | 6/1976 | Edstrom et al. | 417/282 |
| 3,987,620 | 10/1976 | Giordano et al. | 60/39.28 T |
| 4,135,860 | 1/1979 | Nedermassel | 417/12 |
| 4,149,827 | 4/1979 | Hofmann | 417/12 |
| 4,171,932 | 10/1979 | Miller | 417/12 |

*Primary Examiner*—William L. Freeh
*Attorney, Agent, or Firm*—Dowell & Dowell

[57] ABSTRACT

A solid state system for controlling a compressor or pump which is driven by a motor, the compressor being loaded or unloaded manually or automatically and proportionally to maintain a selected suction-pressure setpoint and to maintain the load on the drive motor within a motor-current setpoint limit, the system having start-up and shut-down sequences which have timed stages including a delay to permit the building up of oil pressure prior to loading of the compressor and including the automatic loading and unloading of the compressor incident to start-up and shut-down. The control includes monitoring of temperatures and pressures associated with the system and automatic shut-down in response to malfunctions internal to the system, and includes automatic shutdown in response to external malfunctions as selectable options, and further includes separate malfunction indicators with a circuit for providing their operability.

18 Claims, 5 Drawing Figures

SOLID STATE COMPRESSOR CONTROL SYSTEM

FIELD OF INVENTION

This invention relates to solid state control and monitoring systems for a compressor or pump driven by a motor, and more particularly relates to automatic loading systems for monitoring parameters including temperatures, pressures, and other functions and maintaining selected setpoints with automatic shut-down in case of malfunctions.

BACKGROUND OF INVENTION AND PRIOR ART

Motor driven fluid compressors, or other pump-type machinery, generally have their loading controlled either by control of the drive motor, or by controlling the fluid circuit by throttling the inlet to the compressor or by on-off bypassing of the outlet of the compressor to some earlier compressor point or stage approaching the compressor inlet. In some systems the control is automatically centered about a setpoint, and may be proportional to the displacement of the momentary operating point from the setpoint.

U.S. Pat. Nos. 3,332,605 to Huesgen and 3,743,442 to Wilson show systems in which discharge pressure is used to load and unload a compressor by throttling the inlet thereto or by bypassing the outlet to the inlet. U.S. Pat. No. 3,961,862 to Edstrom et al shows a mechanical system for throttling the inlet to a screw compressor according to measured outlet pressure. U.S. Pat. No. 2,613,026 to Banks shows a mechanical system for throttling the inlet flow according to the sensed inlet pressure, and U.S. Pat. No. 3,535,053 to Jednacz shows a system for throttling the inlet flow in response to the discharge temperature of the fluid compressed.

U.S. Pat. No. 3,535,053 to Jednacz further shows the concept of measuring current to a compressor drive motor and using this measurement to limit loading of the compressor when the current to the drive motor reaches a predetermined level. U.S. Pat. No. 3,743,442 to Wilson shows a similar system for providing drive motor overload protection, while U.S. Pat. No. 3,088,655 to Miller provides for compressor shut-down when the drive engine begins to overheat.

U.S. Pat. No. 3,478,731 to Morton et al teaches a system for starting up an engine driven compressor using a fixed sequence and having means for tripping the start cycle in the event of a malfunction. The system also uses a pre-lube step, and in this regard, U.S. Pat. No. 3,957,395 to Ensign is also of interest and provides various malfunction sensitive circuitry. U.S. Pat. No. 3,291,146 to Walker provides sequentially programmed start-up and shut-down cycles, for a steam turbine instead of a compressor however.

U.S. Pat. No. 3,673,811 to Adams provides an oil pressure failure sensor with a feature to allow start-up at a time when there has been no oil pressure for a while. U.S. Pat. Nos. 3,088,655 to Miller, 3,232,519 to Long and 3,987,620 to Giordano et al provide warnings of malfunctions based on temperatures, pressures, overload, etc., and provide indicators for showing the nature of the problem. U.S. Pat. No. 3,934,238 to Pavlou includes apparatus for measuring pressure drop across an oil filter as an indication of the degree of clogging of the filter.

The present invention provides improvements over the showings of the aforementioned prior art, which improvements are summarized in the objects of the invention set forth hereinbelow, and as illustrated in an embodiment using a screw compressor of the general type shown in U.S. Pat. No. 3,986,801 to Garland.

SUMMARY OF INVENTION

The invention comprises a solid state control system connected with a motor driven compressor, the system controlling the loading of the compressor in a proportional manner by moving a bypass slide valve at a rate which is proportional to the present error between the measured inlet suction pressure and a selected setpoint, the automatic control being overriden to inhibit further loading whenever another setpoint representing maximum motor current is approached. If this maximum motor current is exceeded the system automatically unloads the compressor sufficiently to remove the overload. Manual adjustment of the compressor loading is also provided. The control system has programmed start-up and shut-down sequences, including delays for initiating and confirming compressor oil pressure before the compressor drive motor is started, and including a delay to prevent compressor loading until it is up to speed. During a start-up or a shut-down sequence the compressor is automatically unloaded. A starts-per-hour timer is initiated after a start-up sequence is begun, and this function prevents restarting of the drive motor for a preselectable interval of time. The control monitors a number of functions both internal to the compressor system, and external thereto, for example, an adjacent installation. Automatic trip circuits initiate the shut-down sequence in the event of a malfunction, for instance a monitored temperature or pressure which is outside of preset limits, and a system of indicator lamps retains a record of the malfunction even after the system is shut-down. A digital panel meter is selectively connectible to the various monitored functions to display quantative readings. The indicator lamps are coupled to a circuit for testing their operability, and circuitry is provided through which remote monitoring indicators can be coupled to the malfunction indicators.

It is the general object of this invention to provide a solid state control system for a motor driven compressor or similar machinery wherein the control is a highly versatile system providing both manual control and automatic proportional control of the loading and unloading of the compressor, and providing effective monitoring of compressor system functions and automatic response to the occurrence of malfunction.

It is a principal object of the invention to provide a solid state control system featuring automatic control of the loading and unloading of the compressor whereby the operating capacity of the compressor is controlled to bring it always within a narrow deadband centered about a preselected setpoint. It is a corollary object of the invention to provide automatic compressor load control which is accomplished without throttling the inlet suction to the compressor. The control system automatically adjusts the position of a slide valve in the compressor to bypass a portion of the outlet pressure toward the suction side of the compressor, and thereby control its present capacity. The parameter on which this control is based is the suction pressure, and the slide valve is moved back and forth hydraulically by alternately actuating a load solenoid valve or an unload solenoid valve in control of the hydraulic ram which moves the slide valve. It is a principal feature of this control system that the operation of the solenoid valve is time proportional, whereby the rate of modulation of the position of the slide valve is proportional to the degree of deviation of the present suction pressure from a selected setpoint for this pressure, the setpoint being adjustable manually at the front control panel during operation of the compressor. When the suction pressure is too high the system actuates the load valve solenoid, and when the suction pressure falls too low the unload solenoid valve is actuated. Within the deadband centered about the setpoint, neither valve is actuated. In the presently manufactured system, the width of the deadband is approximately plus or minus 0.5 p.s.i. The time proportional action of the compressor loading and unloading portion of the control system provides a highly satisfactory control about the setpoint because the length of time that either of the solenoid actuator valves remains opened is proportional to the deviation of the suction pressure at that time from the setpoint. As a result, the control system moves the slide valve rapidly when the suction pressure error is great, but moves the slide valve more slowly as the suction pressure approaches the setpoint pressure, whereby the slide valve moves slowly into the deadband where neither solenoid valve is energized and thus avoids overshoot or hunting.

It is another major object of the invention to provide a solid state control system featuring automatic loading and unloading of the compressor capacity, but in which the power drawn by the main compressor drive motor is monitored and used to override the loading setpoint system in two ways. A monitoring circuit delivers an analog voltage representing present motor current to two comparators. A setpoint voltage circuit delivers a setpoint voltage to one comparator, and a slightly smaller setpoint voltage to the other comparator. Thus, when motor current rises, the comparator with the lower setpoint voltage will first deliver a signal which is connected to inhibit any further loading of the compressor by the automatic circuit, this occurring just before the higher setpoint comparator delivers an output if the loading continues to increase. When the latter comparator delivers its output, it not only blocks any further loading of the compressor, but it also actuates the unloading solenoid valve of the compressor, thereby reducing the loading thereon until the measured current through the drive motor no longer is great enough to exceed the setpoint reference potentials applied to the comparators. Thus, the motor overload current sensing circuit overrides the inlet suction pressure sensing circuit and provides the necessary inhibit signal when overload is approached and the necessary unload signal when overload has occurred, whereby the system can be normally operated at the greatest pumping capacity at which the drive motor will not be overloaded. During motor load override the movement of the capacity control slide-valve is constant until the overload condition is corrected.

It is another major object of this invention to provide a solid state control for a motor-driven compressor which provides a sequential start-up program and a sequential shut-down program for the system. The start-up of the compressor is begun by manually pressing the run button on the control panel. According to the start-up program, the oil pump is started immediately, but an oil pressure failure circuit is delayed for a few seconds until the oil pump has had time to build up the oil pressure. During this initial delay, and several subsequent delays, the compressor unloading valve solenoid is actuated so that the compressor slide valve is moved to the unload position. At the end of the first programmed delay, the oil pressure failure circuit is activated, and at this stage the oil pump will be shut-down and the circuit returned to a shut-down condition unless the required oil pressure is reached. If the oil pressure failure circuit does not trip the system to the shut-down condition, after a brief further delay the compressor motor is started. After a further delay to permit the compressor to be brought up to speed the compressor loading circuit is enabled, whereupon the compressor load control system will begin loading the compressor to achieve the inlet suction pressure selected by the associated setpoint. At all times during operation of the main compressor drive motor, its degree of loading is being monitored as set forth in the preceding paragraph. If the compressor is shut down for any reason except oil pressure failure, a programmed shut-down delay circuit becomes operative. The compressor motor is turned off immediately when a shut-down occurs, but a shut-down timer is activated, during the timed interval of which the unloading solenoid valve is opened.

It is a further object of the invention to provide means for limiting the number of starts-per-hour of the system in a manner which cannot be defeated by the operator, for instance by turning off the front panel main power switch and then turning it back on. It is standard procedure for a manufacturer to place a limitation on the number of permissible starts-per-hour for a heavy drive motor of the type used to drive large compressors. The present system provides a delay which becomes operative whenever the compressor motor control is actuated to "on" condition. The delay has a selectable duration which can be changed only by a locked switch requiring a key for its operation. Whenever the compressor motor is started-up, a capacitor having a certain charge storage capability is charged, and its charge is leaked off at a rate controlled by a resistor connected thereacross. The rate of leakage is independent of any other function in the control system, and until the capacitor charge has leaked off to a certain level, it is impossible to restart the compressor system by pressing the run button. Since it is the turning "on" of the compressor motor which initiates charging of the capacitor, the motor cannot be started again until the delay interposed by the capacitor has timed out, although after it has timed out the compressor may be shut down and immediately restarted.

It is another major object of the invention to provide a solid state compressor control system having transducer circuitry for measuring a number of system functions or parameters including temperatures, pressures and loading of the main drive motor, these measurements being associated with trip circuits which are connected to a malfunction control operative to achieve shut-down of the system by beginning the programmed shut-down sequence. The automatic shut-down system includes malfunction indicator lamps for all of the measured malfunctions, these lamps being connected to the trip circuits by separate latch circuits which are strobed automatically whenever the malfunction control is actuated so that before the system has had time to shut-down, the latches will acquire and preserve the status of each malfunction circuit and will keep the warning lamp for that circuit in the condition of operation or non-operation existing at the instant that the malfunction control is actuated. A reset of these malfunction indicators is necessary as part of the start-up cycle of the system. In addition, a relay is also associated with each trip circuit and is maintained closed by whichever latches are holding an indication of malfunction, these relays serving to permit easy connection of remote monitoring apparatus to the present system.

It is a further object of the invention to provide external malfunction and/or alarm circuits which have inputs adjustable to receive malfunction signals of either polarity coming from contacts which are located externally of the present compressor and control system, whereby the operator of the present system can make the system also responsive to other systems which may be operating in the vicinity. In addition this external malfunction system is provided with switches for selecting which of several possible external malfunctions will automatically shut-down the present compressor system when an alarm condition occurs. The external malfunction system has indicator lamps and relays for connection to other remote points, which relays are similar to those appearing in the internal malfunction system. The lamps used throughout the present system are wired to a test circuit by which the operativeness of all warning lamps can be tested simultaneously by pushing a single button on the control panel.

It is not necessary that a malfunction must necessarily result in shut-down of the compressor system on an automatic basis. The present system includes means for measuring the differential pressure across the main filter in the oil pump circuit which is responsive to clogging of the oil filter, and which provides an indication of clogging at a sufficiently early stage thereof that shut-down of the compressor system is not immediately necessary.

Other objects and advantages of the present invention will become apparent during the following discussion of the drawings.

DESCRIPTION OF A PREFERRED EMBODIMENT

The figures of the drawings illustrate a preferred embodiment of a solid state control system having particular utility for use in connection with fluid compressor or pump systems, a typical embodiment of an air conditioning compressor system being illustrated wherein the compressor is of the rotary screw type generally illustrated and described in our U.S. Pat. No. 3,986,801.

Figure 1:
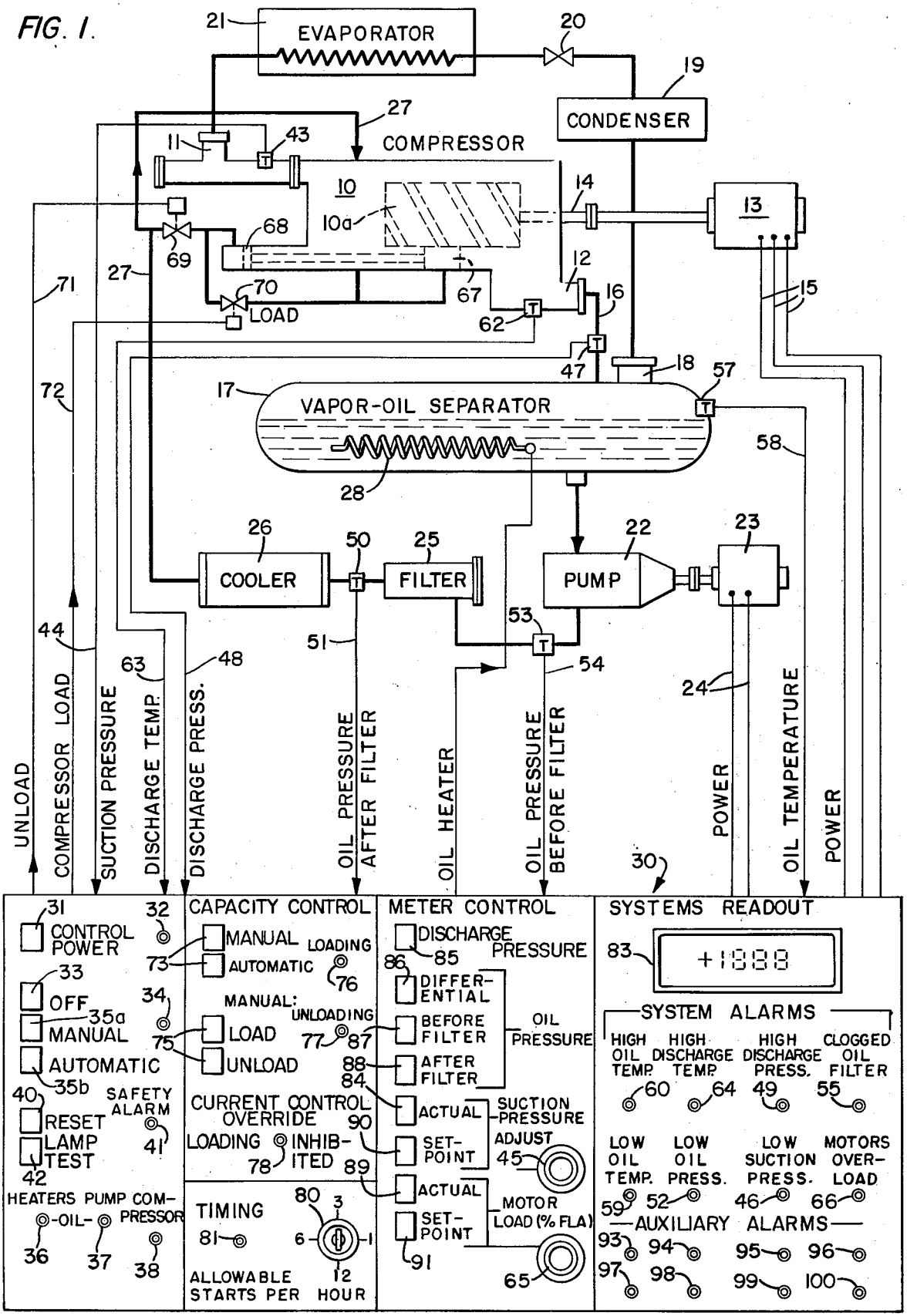
FIG. 1 is a diagram showing an illustrative embodiment of an air conditioning compressor and drive connected to a panel representing the solid state control and monitoring system according to the present invention.

FIG. 1 shows a compressor 10 having a suction pipe 11 and a discharge pipe 12. The compressor 10 is driven by a motor 13 through a drive shaft 14, the motor being supplied with electricity through the three-phase wires 15. The compressed operating fluid together with lubricating oil is delivered through a line 16 into a vapor-oil separator 17, and the compressed vapor is then delivered through a discharge line 18 into external portions of the air conditioning system including a condenser 19, an expansion valve 20 and an evaporator 21 which discharges the vapor back into the suction pipe 11 of the compressor 10. It is to be understood that these features merely illustrate one possible system in which the system would have utility, there being many other fluid pumping purposes for which it might be used.

The compressor is lubricated by oil taken from the separator 17 and delivered through an oil pump 22 which is driven by a motor 23 to which electricity is supplied by way of electrical wires 24. Oil under pressure is delivered from the pump into an oil filter 25, and then is passed through an oil cooler 26 and delivered to the compressor 10 through the pressurized oil line 27.

Near the bottom of FIG. 1 there is illustrated in block diagram form a solid state compressor control and panel 30. The details of the circuitry within the control box 30 are illustrated in subsequent drawings, FIG. 1 showing only the front panel controls and indicators. FIG. 1 further shows the various interconnections between the compressor drive and fluid circuitry and the solid state control system. These interconnections include among others the power lines 15 going to the main compressor drive motor 13 and the power lines 24 going to the motor 23 which drives the oil pump 22. The control 30 is connected to the city power mains (not shown), and the power to the control system is turned on and off by a main power switch 31, its "on" condition being indicated by an indicator lamp 32 adjacent thereto. The operate-run sequence of the compressor, FIG. 1, is initiated by one of the push buttons 35*a* "MANUAL" or 35*b* "AUTOMATIC", and is shut-down by the switch 33, an indicator light 34 adjacent thereto signalling the run condition, when selected. In addition, an indicator lamp 36 is illuminated when the oil heater 28 is "on". An indicator lamp 37 indicates when the oil pump motor 23 is turned "on", and an indicator light 38 is illuminated when the compressor drive motor 13 is in operation. The push button 40, located to the left on the front panel in FIG. 1, operates as a "reset" button for resetting the solid state control system to an initial condition prior to start-up of the system. The indicator light 41 is illuminated whenever it is necessary that the operator press the reset button before he can proceed with further operation of the compressor system. The push button 42 is an indicator lamp test button which lights all of the lamps on the front panel 30 for the purpose of proving their operability.

As will be described in detail hereinafter in connection with FIG. 4, the solid state control system further includes a number of automatic trip circuits and alarm circuits which serve either to warn of a malfunction, and/or automatically shut-down the compressor system. These malfunction warnings and automatic trip means operate in response to the outputs of various transducers which are each represented in FIG. 1 by a box containing the letter T and which measure functions of the compressor and associated equipment with regard generally to pressures and temperatures therewithin, or with regard to the amount of current being drawn by the main compressor drive motor 13. A transducer 43 located in the suction pipe of the compressor measures the suction pressure and delivers an electrical signal on wire 44 into the control system 30. A circuit in the control system 30 is responsive to suction pressures falling below a setpoint which is set on the front panel by the operator of the system by turning the knob 45. Automatic circuitry is set into operation within the control system 30 as will be set forth hereinafter.

A transducer 47 measures the discharge pressure from the compressor and delivers an indication on wire 48 into the control system 30, and automatic circuitry within the control system 30 responds to discharge pressures exceeding a predetermined level, whereupon a warning lamp 49 is illuminated on the front panel 30.

A transducer 50 located after the oil filter and transducer 47 delivers an electrical signal on the wire 51 to the control system 30, which is automatically responsive to low oil pressure which comprises oil pressure falling below the permissible level as measured above compressor discharge pressure. Such low pressure will illuminate the light 52 on the front panel. Moreover, a transducer 53 is connected in the oil pressure line before the filter 25, and it delivers an oil pressure signal on the wire 54 to the control panel. The control system 30 monitors the differential oil pressure represented by the outputs of the transducers 50 and 53, and illuminates a warning lamp 55 if the differential pressure across the filter exceeds a predetermined level indicating a clogged oil filter.

A temperature transducer 57 delivers an indication of oil temperature on the wire 58 to the control system 30, the system having circuitry for lighting the lamp 59 if the oil temperature is too low or lighting the lamp 60 if the oil temperature goes too high, there being a temperature range within which neither warning lamp is lighted and this being the operative temperature range. In addition, the discharge temperature of the vapor and oil mixture is measured at the compressor by a transducer 62, which delivers a temperature indication to the control system 30 on the wire 63. If the discharge temperature exceeds a predetermined level, the warning light 64 is illuminated on the panel.

The suction pressure, the discharge pressure and temperature, the oil temperature and oil pressure functions are associated with automatic trips which shutdown the system as will be described in detail in connection with subsequent drawings.

The rate of electrical power consumption by the main motor 13 which drives the compressor 10 is also monitored in the control system 30, and the operator selects a setpoint using the dial 65. Automatic circuitry within the control system 30, FIG. 3, then measures the amount of electric current flowing to the drive motor 13 and provides a warning on the front panel at the lamp 78 when the motor 13 is overloaded as determined by a comparison of its current with the setpoint selected by the knob 65.

The amount of loading on the compressor, and therefore upon the motor 13 is determined by the position of the slide valve 67 which is located within the compressor and forms an integral part thereof. The slide valve is reciprocable back and forth adjacent to the compressor screws **10*a* and performs the well known function of bypassing some of the discharge of the compressor toward the suction ends of the screws 10*a*. When the slide valve 67 is pushed all the way to the right-hand side, the compressor is bypassed as fully as is possible using the slide valve. On the other hand, when the slide valve 67 is moved toward the left, the degree of bypassing decreases and therefore the loading on the compressor 10 and motor 13 is increased. The slide valve is moved back and forth by introduction of oil pressure on one side or the other of the hydraulic ram 68 using an unload solenoid valve 69 and a load solenoid valve 70 which are respectively controlled by electrical signals delivered on the wires 71 and 72 coming from the control system 30 to either unload or load the compressor selectively in a manner to be hereinafter discussed. The loading and unloading of the compressor is controlled either automatically or manually, depending upon the setting in FIG. 1 of the manual or automatic push buttons 35*a* and 35*b* which shift the switch 73, FIG. 3**.

When the automatic push button **35*b* is depressed, an internal circuit described hereinafter controls the loading and unloading of the compressor and also maintains the current drawn by the drive motor 13 no higher than the setpoint selected by knob 65. On the other hand, when the push button 35*a* moves the switch 73 into the manual position, then the loading and unloading is controlled manually by the push button switches 75. When the load switch is activated, the loading is increased, and the lamp 76 indicates further loading to be in progress, namely when the wire 72 is delivering a control signal to the load actuator solenoid 70. On the other hand, when the unload switch 75 is activated, the wire 71 going to the unload actuator solenoid 69 is energized by a control signal, and this fact is indicated by the unload indicator lamp 77. The indicator lamp 78 is illuminated if during manual operation the operator loads the compressor for too long a period of time causing the loading to exceed the setpoint selected for the motor loading by the setpoint select knob 65**.

The allowable starts-per-hour switch 80 is key operated and can be set to permit 1, 3, 6 or 12 starts of the compressor drive motor per hour. This circuit will be described hereinafter, and involves a timer which is actuated when the compressor motor 13 is turned on. The motor cannot again be restarted until the timer runs out, and a lamp 81 on the front panel, when illuminated, indicates that the timer is in the process of timing its interval and that the compressor cannot be started so long as the lamp 81 is illuminated.

Finally, a digital panel meter 83 is provided which displays digital indications of the various system parameters being measured by the circuitry including the transducers T. The meter is switched to different monitoring circuits to read different values. When the push button 84 is pressed, the meter reads suction pressure in PSIA. Pressing of the button 85 connects the panel meter to read discharge pressure PSIA. A circuit within the control system 30, FIG. 4, takes the oil pressure after the oil filter as measured by the transducer 50 and subtracts from it the discharge pressure to obtain the differential oil pressure above discharge pressure, which can be displayed on the digital panel meter by depressing of the push button 86. The oil pressure before the filter is displayed by the digital panel meter when the push button 87 is pressed, and the oil pressure after the filter can be displayed on the digital panel meter 83 by pressing the push button 88.

The loading of the main drive motor 13 is measured by a circuit in the control system 30 and is displayed as a percentage of the full load amperage for which the drive motor 13 is rated when the push button 89 is pressed.

When the push button 90 is pressed the suction pressure setpoint as selected by the knob 45 is displayed to facilitate accurate setting of the knob, and when the push button 91 is pressed the motor load setpoint as selected by the knob 65 is displayed to facilitate setting of the knob.

Figure 5:
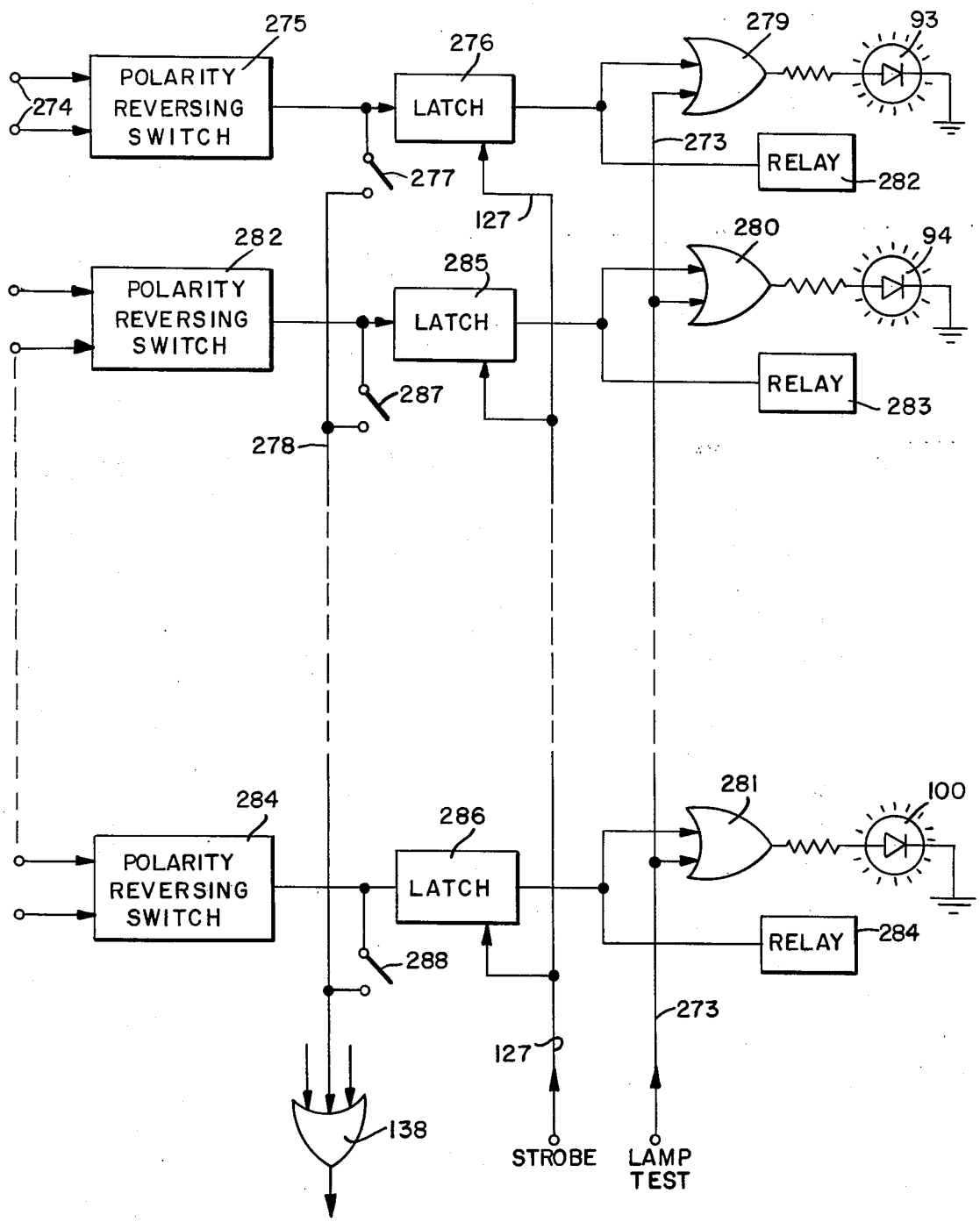
FIG. 5 is a schematic diagram showing external malfunction responsive controls and indicators which are responsive to malfunctions that are external with respect to the compressor and control system of the present invention.

Finally, the lamps 93 through 100 inclusive are provided together with appropriate circuitry for their operation, FIG. 5, and these circuits can be connected to optional external parameters and functions to be monitored, for instance, functions of other machinery systems contained in the same building or associated therewith.

Figure 2:
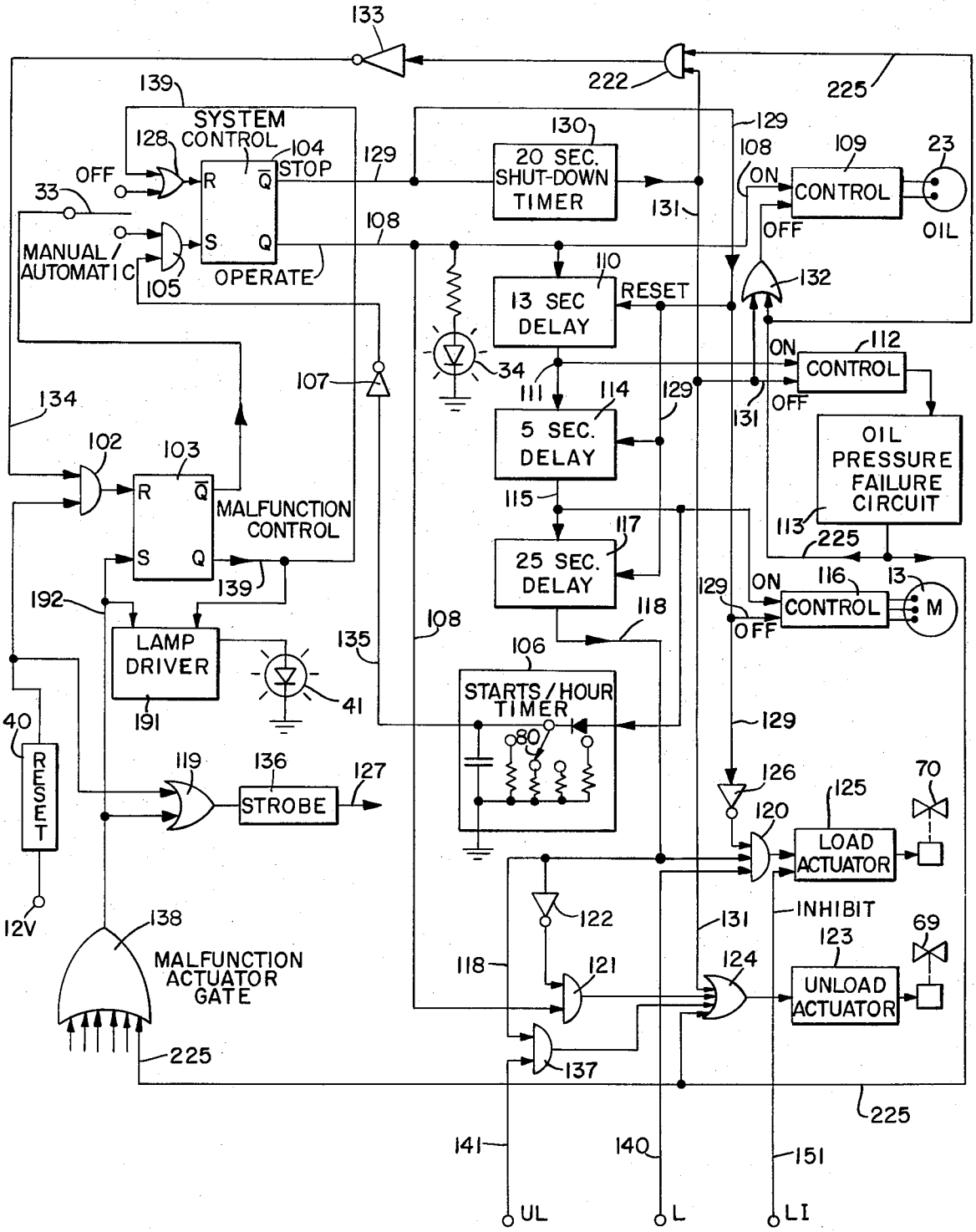
FIG. 2 is a schematic diagram showing the circuitry for operating and running the compressor system shown in FIG. 1 including a start-up sequence and a shut-down sequence responsive either to manual shut-down or to automatic malfunction shut-down.

FIG. 2 shows the starting up and shutting down logic of the main control system. FIG. 2 repeats some of the components shown in FIG. 1, including the compressor main drive motor 13, the oil pump drive motor 23, the solenoid load valve 70, the solenoid unload valve 69, and the operate run-switch 33, 35*a* and 35*b*. FIG. 2 also repeats a showing of the reset push button 40, and of the indicator lights 34 and 41 respectively.

For the sake of ease of illustration, it will be assumed that the illustrated logic components are responsive to a binary high signal input as distinguished from a binary low input, even though in actual practice some of the circuitry may respond to different polarities.

When the power switch 31 is turned "on" on the front panel in FIG. 1, the indicator lamp 32 is lighted and will continue to glow. If any of the failure alarm systems have been tripped, the reset system light 41 will also glow, indicating that it is necessary for the operator to press the reset button 40 on the front panel before the system can enter the run mode. The upper input to the AND gate 102 will be high, and therefore a high signal applied to the lower input to the AND gate 102 from the reset button 40 will reset the malfunction control flipflop 103 causing the $\overline{Q}$ output to go high, except when the failure is caused by low oil pressure, in which case the reset function will be delayed 20 seconds as will be described hereinafter. Until the reset button is pressed, the flipflop 103 may be in set condition, in which case the glow lamp 41 will remain lighted continuously until the reset button 40 is pressed. When the reset button is pressed, the operate-run switch 33 will be energized, so that when the button 35*a*, FIG. 1, is pressed into the MANUAL position, the system control flipflop 104 will be set through the gate 105, thereby making the Q output on wire 108 high and lighting the run indicator lamp 34. The high signal put on the upper input of the AND gate 105 will set the system control flipflop 104 only if the interval of time from the next previous start was longer than the delay timer 106 is set for. If this is true, the output of the timer itself will be low, and this low signal will be inverted by the inverter 107 to place a high signal on the lower input to the AND gate 105. When the flipflop 104 is set, a high signal will appear on the wire 108 and this high signal will turn on the control circuit 109, thereby immediately starting the oil pump motor 23. The high signal on the wire 108 will also actuate the delay 110. After 13 seconds, a high signal will appear on the output 111 of the delay 110, and this signal will turn on the control circuit 112 which enables the oil pressure failure circuit which is generally referred to by the reference character 113, but is shown in greater detail in FIG. 4. The output from the delay 110 also triggers the delay 114, and at the end of 5 additional seconds, the delay 114 delivers a high signal at its output 115, and this high signal turns on the control circuit 116 and starts the main compressor drive motor 13. The output signal on wire 115 also initiates the delay 117, which delays another 25 seconds and then delivers an output on wire 118 which enables one of the inputs to the AND gate 120, while disabling one input to the AND gate 121 through an inverter 122.

It is noted that before the delay 117 delivers a high signal on wire 118, the upper input to the AND gate 121 is enabled through the inverter 122, and the other input to the AND gate 121 is also enabled through the wire 108. As a result, until the delay 117 goes high after 25 seconds the solenoid unload actuator 123 is being enabled through the OR gate 124 from the AND gate 121, thereby actuating the unload solenoid valve 69 to move the slide valve 67 in the compressor in the direction to unload the compressor. At the end of the 25 seconds, when the delay 117 delivers its output on wire 118 the AND gate 121 is disabled, thereby ceasing unloading of the compressor, and the AND gate 120 becomes enabled through the wire 118, thereby permitting a load control signal from the terminal L coming from the compressor load control circuit as shown in FIG. 3 to begin driving the load solenoid valve 70 through the load actuator 125, as will be hereinafter discussed in connection with FIG. 3.

Figure 3:
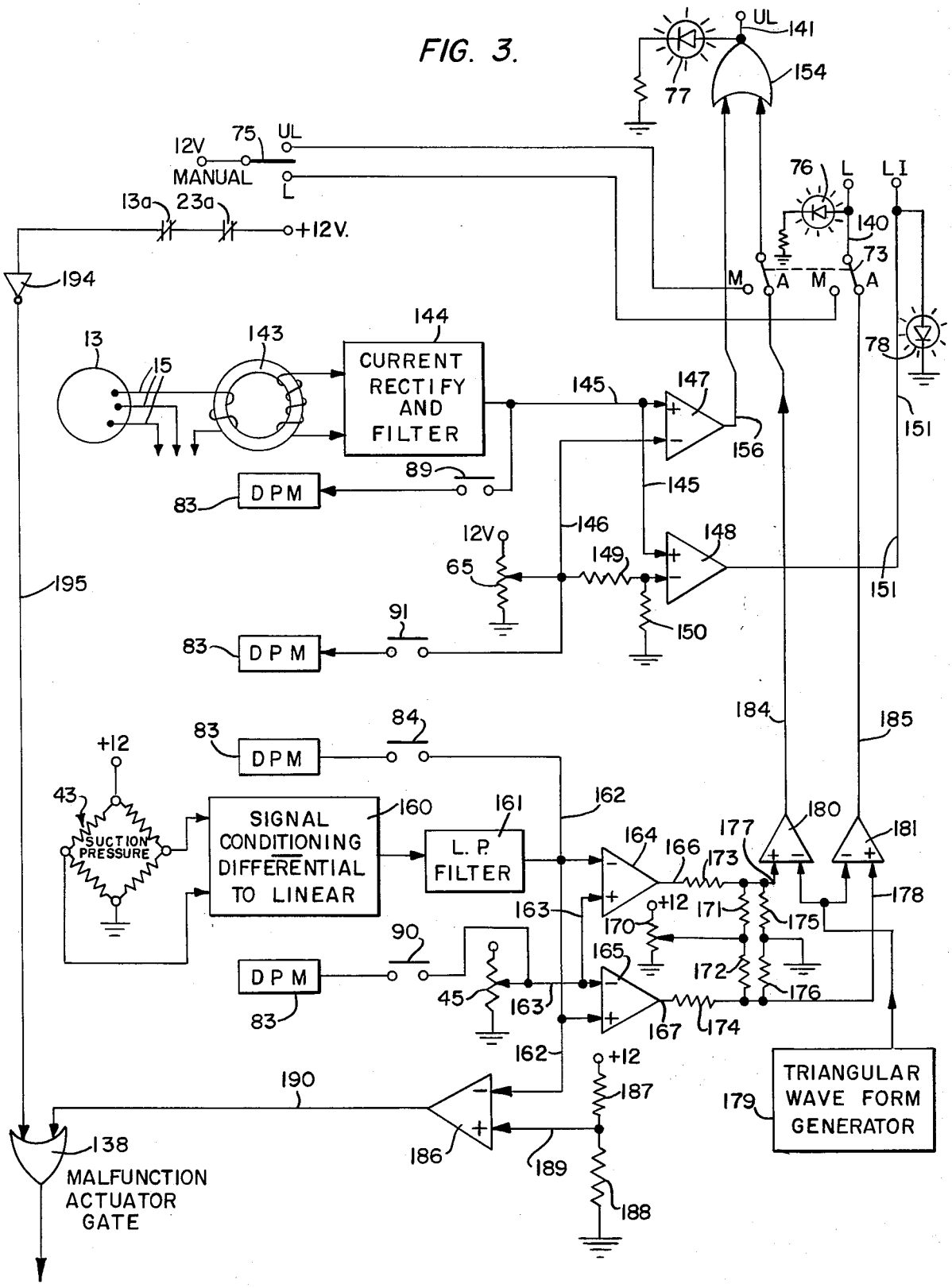
FIG. 3 is a schematic diagram showing a portion of the solid state control system which controls automatic loading and unloading of the compressor in response to suction pressure and drive motor overload, and which provides for automatic shut-down under certain malfunction conditions.

Thus, pressing of the operate-run switch 33 to either the MANUAL or to the AUTOMATIC run position immediately turns on the oil pump, delays 13 seconds, turns on the oil pressure failure circuit, delays 5 seconds, turns on the compressor drive motor, and after 25 seconds changes from an unloading initial mode to a mode in which the compressor can be fully loaded by the circuit shown in FIG. 3. The upper input to the AND gate 120 is high during the entire time that the wire 129 from the $\overline{Q}$ output of the flipflop 104 is low, namely during running of the system.

Conversely, the compressor can be shut down by pressing the operate-run switch 33 to the OFF position, in which case a high signal passes through the OR gate 128 and resets the flipflop 104, thereby placing a high signal on the wire 129. This high signal on the wire 129 immediately disables the load actuator circuit 125 by disabling the AND gate 120 through the inverter 126, thereby preventing further loading of the compressor. In addition, the signal on wire 129 turns off the controller 116 for the main drive motor 13, stopping the compressor. The signal on the wire 129 also resets the three delays 110, 114 and 117, and actuates the shut-down timer 130. This latter timer delivers an output for an interval of 20 seconds on the wire 131 which achieves unloading using the compressor slide valve 67 as a result of actuating the unload solenoid valve 69 through the unload actuator 123 via the OR gate 124. The high on the wire 131 further operates to turn off the control circuit 112 for the oil pressure failure system 113, and delivers a signal through the OR gate 132 to turn off the control circuit 109 for the oil pump motor 23. When low oil pressure is signalled by a high on wire 225, and the shut-down timer 130 is simultaneously delivering a high on wire 131, the AND gate 222 delivers a high and the inverter 133 delivers a low signal to the wire 134 and to the AND gate 102 to prevent actuation of the reset button 40 to reset the malfunction flipflop 103 until after the shut-down timer 130 has timed out at the end of 20 seconds.

Whenever the motor 13 is started, the starts-per-hour timer 106 is initiated and it delivers a high signal at its output wire 135 which places a low on the lower input of the AND gate 105 through the inverter 107, whereby the AND gate 105 is disabled during whatever interval the timer 106 is set for. For instance, if the timer is set to allow three starts-per-hour using the key switch 80 on the front panel, in this position the timer will go high for 20 minutes before timing out and again enabling the AND gate 105. Any effort to commence again the running of the compressor during that interval will fail. According to the front panel shown in FIG. 1 there are three additional selections including a one starts-per-hour selection providing a 60 minute delay by the timer 106, a 6 starts-per-hour selection providing a 10 minute delay between starts and a 12 starts-per-hour selection providing a 5 minute delay between starts.

In addition, there is a malfunction actuator OR gate 138 which receives signals from various malfunction trip circuits and operates to automatically set the malfunction control flip-flop 103 to shut down the system by an output appearing on the wire 139 and passing through the OR gate 128 to reset the system control flipflop 104.

Once the system is properly operating and the compressor is up to speed, then either loading or unloading can be achieved by the circuits shown in FIG. 3 which deliver control signals at the inputs labelled L and UL. When the circuit is operating properly, the AND gate 120 is enabled to permit load control signals from the terminal L to drive the actuator 125 and the solenoid valve 70. Furthermore, the AND gate 137 is also enabled normally to allow control signals appearing at the terminal UL from the unload circuit of FIG. 3 to drive the unload actuator 123 and solenoid valve 69 through the gates 137 and 124.

The push buttons 35*a* and 35*b* appearing on the front panel of the control system shown in FIG. 1 selects between automatic and manual control of the loading of the compressor by actuating the switch 73 in FIG. 3 to either mode, thereby moving the slide valve 67 back and forth to change the amount of by-passing around the screw compressor.

FIG. 3 shows the manual/automatic switch 73, near the upper right-hand corner of the drawing, in the automatic selection position. If the switch is moved to the manual selecting position, the manual control switch 75 is actuated so long as the operator holds it either in the loading position or in the unloading position. Switch 75 is connected to 12 volts, and therefore, when the load switch is depressed, the wire 140 delivers a high, and this enables the AND gate 120, FIG. 2, to deliver an enabling control signal to the compressor load actuator 125 which opens the solenoid valve 70, thereby equalizing oil pressure on both sides of the piston 68 and permitting the discharge pressure near the right-hand end of compressor screws 10*a* to push the slide valve 67 leftwardly, thereby to decrease the bypassing and increase the loading of the compressor 10. Conversely, if the manual switch 75 is actuated to achieve unloading through the OR gate 154, the wire 141 goes high, thereby delivering a high control signal through the AND gate 137 and the OR gate 124 and into the compressor unload actuator 123 which actuates the solenoid control valve 69 to admit oil pressure to the left of the piston 68, and thereby drive the slide valve 67 rightwardly to decrease the loading on the compressor by increasing the amount of bypassing. When the compressor is being further loaded by a control signal on wire 140 the lamp 76 is illuminated, whereas when the compressor is in the process of being unloaded by a control signal on wire 141 the lamp 77 is illuminated.

Since it is possible for an operator to continuously hold the switch 75 in the loading position, it is therefore also possible for the operator to overload the motor 13 which drives the compressor. The circuit associated with the motor 13 as shown in FIG. 3 serves to inhibit overloading of the compressor even when a person holds the manual switch 75 continuously in the loading position as previously discussed. The current through the electric motor 13 in one of the three phase legs of the power lines 15 is continuously sampled by a current transformer 143 which has a secondary winding which drives a current conditioning circuit 144 which rectifies the current through the secondary winding of the current transformer 143 and filters it to produce a DC analog voltage on the wire 145 which is proportional to the current being drawn by the electric motor 13 and is therefore indicative of the degree of loading thereof by the compressor. This analog value can be displayed by depressing the push button 89 and delivering the analog voltage on wire 145 to the digital panel meter 83. The analog voltage appearing on the wire 145 is compared against a preset reference voltage obtained from the potentiometer 65 the control knob of which is shown on the front panel in FIG. 1. The level of this reference voltage can be read in the digital panel meter 83 by depressing the push button 91. The maximum level of the voltage appearing on wire 145 is set to equal about 5 volts which represents 1.5 times the full load current for the motor, this analog voltage diminishing as the loading on the motor is decreased, and following the loading in a substantially linear manner. The potentiometer 65 is used to select a setpoint representing the load current of the motor which must not be exceeded by loading of the compressor using the slide valve 67. This setpoint voltage appears on the wire 146, and is delivered as a reference voltage to one input of two comparators 147 and 148. The full reference setpoint voltage is delivered to the other input to the comparator 147, but resistors 149 and 150 are used to slightly reduce the reference voltage applied to the other terminal of the comparator 148 whereby this comparator will receive a lower voltage as a reference. Thus, when a rising analog voltage representing the current being drawn by the motor 13 at the present time is applied to both comparators on the wire 145, the comparator 148 will be the first to signal coincidence of the analog voltage with the reference voltage, and therefore will be the first to deliver a high output on the wire 151. This high signal on the wire 151 will be delivered to the load inhibit terminal LI and will inhibit the compressor loading actuator 125, thereby preventing any further loading of the compressor even though the manual switch 75 may still be held in the loading position. Moreover, whenever the load inhibit wire 151 is energized, the lamp 78 will glow steadily to warn the operator that the motor load setpoint has been exceeded and the compressor may not be further loaded. If the motor current remains high and rises still further, as soon as it is 5% above the setpoint, the comparator 147 will also detect coincidence and will deliver a signal on the wire 156, which signal passes through the OR gate 154 and energizes the unloading wire 141 which passes a control signal through the AND gate 137 and the OR gate 124 to cause the actuator 123 to open the solenoid valve 69 and commence the process of unloading the compressor by moving the slide valve to increase the amount of vapor being bypassed. The unloading will continue until the current drawn by the motor 13 decreases to a level about 5% below the setpoint as determined by the selector 65, and then the comparator 147 will stop delivering a signal on the wire 156, and unloading will cease. Thus, the comparator 148 inhibits loading as soon as the motor current as represented by the analog on wire 145 approaches the setpoint selected by the potentiometer 65, and thereafter the comparator 147 becomes operative to commence actual unloading of the compressor as soon as the analog on wire 145 exceeds the setpoint.

FIG. 3 also shows the automatic circuitry used for loading and unloading of the compressor based upon measured suction pressure. The suction pressure in the present circuit is measured by a standard transducer means of a type known in the prior art and shown as the transducer bridge 43 in FIG. 3. The outputs from the suction pressure transducer 43 are delivered differentially into a signal conditioning circuit 160 which changes the differential input to a linear output analog voltage which passes through a low pass filter 161 and appears on the wire 162. In the manufactured system, this analog signal has a maximum amplitude of about 5 volts, and varies linearly as the suction pressure decreases at the inlet pipe 11 to the compressor 10. By depressing the push button 84, the level of the suction pressure can be read on the digital panel meter 83. A setpoint selection potentiometer 45 can be used by the operator to select a desired setpoint toward which the circuit will automatically progressively adjust the suction pressure. By depressing the push button 90 the operator can read the suction pressure setpoint on the digital panel meter 83.

The suction pressure setpoint voltage appearing on the wire 163 is delivered to two differential amplifiers 164 and 165, but is oppositely phased on their inputs. The analog signal appearing on wire 162 and representing suction pressure is also applied on opposite terminals of the two amplifiers 164 and 165. As a result, if the analog signal on wire 162 falls below the setpoint signal on wire 163 the amplifier 164 will deliver an analog output on wire 166 which is proportional to the difference in input signals, and the amplifier 165 will have no output. Conversely, if the analog signal on wire 162 goes above the setpoint signal on wire 163, the amplifier 165 will deliver an analog signal on wire 167 which is proportional to the difference in input signals, and the amplifier 164 will have no output.

In between these two output conditions on wires 166 and 167, a deadband is provided by introducing a deadband voltage taken from the potentiometer 170 and delivering this deadband voltage via the resistors 171 and 172 to mix this potential with the outputs on the wires 166 and 167 through the resistors 173 and 174. In other words, the deadband voltage serves as threshold which must be overcome by the analog signal which appears on one or the other of the wires 166 or 167 near the cross over points of the amplifiers 164 and 165. The resistors 175 and 176 draw current through the resistors 173 and 174 so as to provide a voltage drop when the deadband voltage is applied by the resistors 171 and 172. The deadband merely represents a small band of suction pressures, about 2 psi in width within which no further automatic adjustment will be made by the automatic load and unload circuit. Therefore, the deadband area tends to prevent hunting on the part of the automatic load/unload circuit.

The output signals of the amplifiers 164 and 165, with the deadband added thereto are then applied through the wires 177 and 178 to the comparators 180 and 181. These comparators are provided with a continuously repeating triangular waveform from the waveforms generator 179 and applied to the inverting inputs of the comparators 180 and 181 as a reference waveform. When an analog voltage appears either on the wire 177 or 178, the associated comparator 180 or 181 will deliver a high signal on its output 184 or 185 only so long as the input analog signal exceeds the instantaneous value of the triangular reference waveform. As the magnitude of the input analog signal increases, it will exceed the momentary value of the triangular waveform for a longer time. Thus, the output signal on one of the wires 184 or 185 is always a pulse train whose duty cycle is proportional to the amplitude of the analog input signal to the same comparator 180 or 181. Since analog input is applied to only one of the comparators 180 or 181 at any particular time, a pulse train will appear at only one of the control signal wires 184 or 185 at any particular instant, depending on whether the measured suction pressure is above or below the setpoint level appearing on wire 163. If a pulse train appears on wire 184 and passes through the OR gate 154 onto wire 141, it will pulse open the solenoid valve 69 to increase the bypass effect of valve 69 to unload the compressor. Conversely, if a pulse train appears on the wire 185 and pulses the wire 140 through the switch 73 the effect will be to pulse open the solenoid valve 70 and thereby increase loading of the compressor by moving the slide valve 67 to a position where less bypassing occurs. The deadband potentiometer 170 is an internal adjustment made at the time the equipment is put into service, whereas the suction pressure setpoint selected by the control 45 can be adjusted by the operator to set the compressor loading to achieve whatever suction pressure is best suited to current ambient operating conditions. It should be particularly noted that the length of each pulse in a pulse train controls how long a solenoid valve will remain open and therefore how rapidly the slide valve 67 is moved by a given pulse train. The pulse duration is, as stated above, proportional to the deviation of the suction pressure away from the setpoint, whereby the control of the slide valve is modulated so that its rapidity of movement is proportional to the size of the deviation from setpoint, but avoids hunting.

One of the malfunction trips is shown at the bottom of FIG. 3. This trip comprises a comparator 186 which is connected to receive the analog voltage on wire 162 representing suction pressure. A voltage divider comprising the resistors 187 and 188 applies a reference potential on the input 189 to the comparator 186. The inputs to the comparator are selected such that if the analog level on wire 162 falls below the reference level on wire 189, a high signal is delivered on the output of the comparator 186 along the wire 190, and this signal is delivered into the malfunction OR gate 138 which actuates the malfunction flipflop 103 and shuts down the compressor in the manner described with reference to FIG. 2.

The main compressor drive motor 13 has an unload trip comprising normally closed contacts 13*a*, and the oil pump motor has a pair of normally closed contacts 23*a* which can be tripped open in the case of an overload. These contacts are connected in series between the 12 volt supply and an inverter 194. If one of these overloads should trip open in response to an overload, a signal is delivered on the wire 195 to the malfunction actuator gate 138, and the compressor system is shutdown automatically according to the procedure set forth with respect to FIG. 2. Other inputs to the malfunction actuator gate will be referred to with reference to subsequent features of the drawings.

Figure 4:
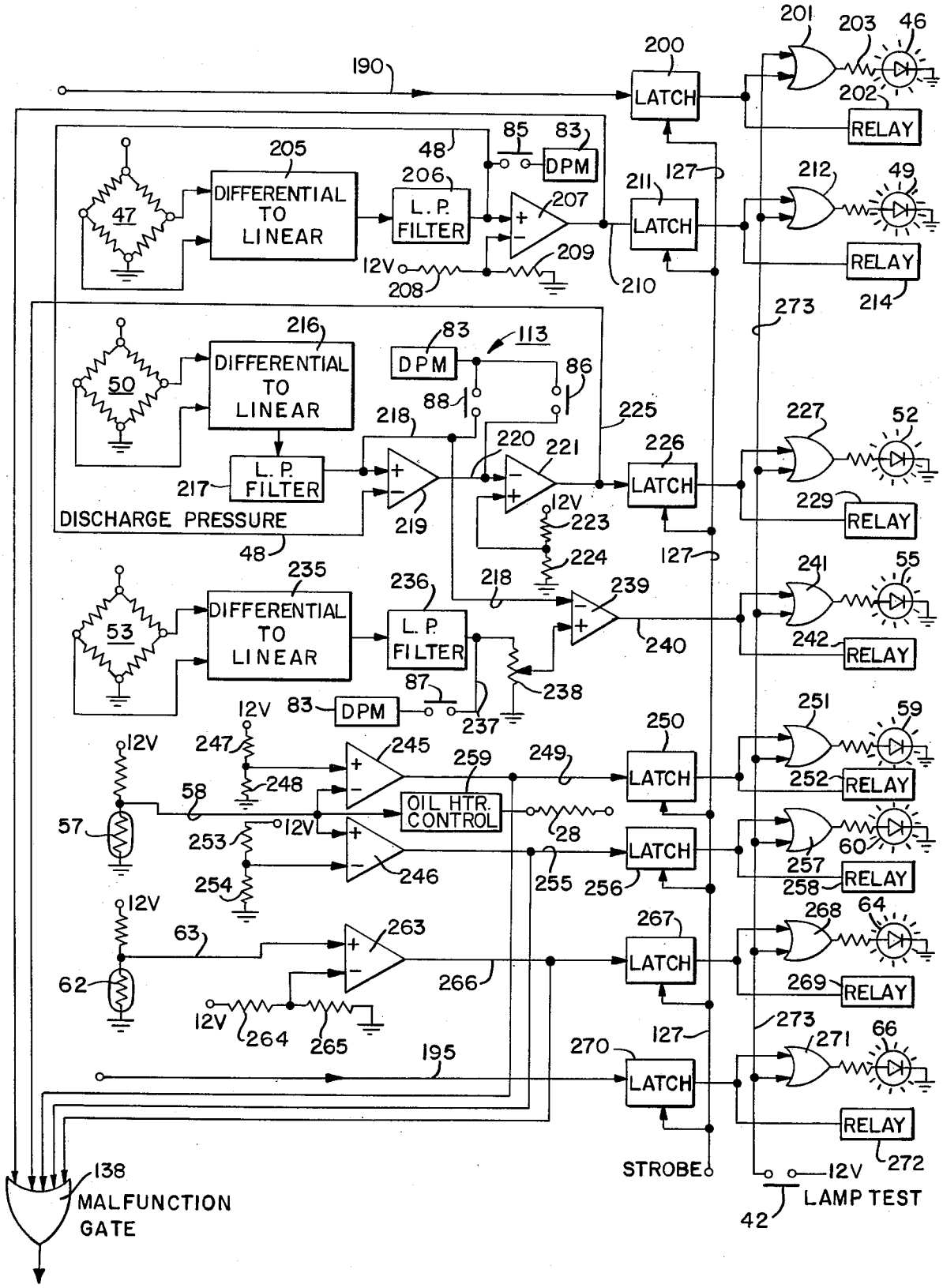
FIG. 4 is a schematic diagram showing transducer means for measuring various functions including temperatures and pressures, and showing indicator lamps for indicating malfunctions among the measured parameters.

FIG. 4 shows the various circuits used to measure other pressures, to measure temperatures, and to automatically trip the circuit of FIG. 2 into a shut-down mode by introducing malfunction signals into the malfunction actuator gate 138. This gate is repeated again in FIG. 4 for the sake of illustration. The circuit at the top of FIG. 4 shows the wire 190 which comes from the low suction pressure circuit shown in FIG. 3, the wire 190 going to the malfunction actuator gate 138. The wire 190 is also connected to a latch circuit 200. When this wire actuates the malfunction gate 138 because of a low suction pressure signal thereon, the strobe circuit 136 shown in FIG. 2 delivers a pulse on wire 127 indicating that a malfunction has occurred and causing all of the latch circuits in FIG. 4 to be strobed and then to hold the condition of their input signals after the compressor system is shutdown, thereby leaving the appropriate indicator lights illuminated and the associated relays closed, as will be described hereinafter. The indicator lamp 46 associated with the low suction pressure wire 190 is illuminated through the OR gate 201 when the latch circuit 200 is holding a malfunction condition taken from the wire 190 and comprising a binary high. The lamp 46 is illuminated and a relay 202 is closed, such a relay being associated with each lamp for the convenience of the operator in connecting external or remote monitoring circuitry to the present control circuit. A dropping resistor 203 is provided in the circuit to limit the current through the lamp 46 from the 12 volt power supply. The latch will keep the lamp 46 illuminated continuously while the source of trouble is being located and cleared even though the compressor is shut-down. When the operator has found the trouble and cleared it, he can depress the reset button 40 and put a signal through the OR gate 119 to again actuate the strobe circuit 136 and put another strobe signal on the wire 127. Since the trouble is cleared, the latch will be reset to a non-malfunction condition and the lamp 46 will be extinguished and the relay 202 opened.

Near the top of FIG. 4, a circuit is provided which is responsive to excessively high discharge pressure from the compressor as measured by the transducer 47 located in the discharge pipe 16 as shown in FIG. 1. The differential pressure transducer 47 delivers a push pull signal into the signal conditioning circuit 205 which changes the differential input from the transducer 47 to a linear single ended output which passes through a low pass filter 206 and is delivered on wire 48 as an analog signal proportional to discharge pressure. In the units being manufactured, the signal varies up to 5 volts DC, which represents 300 PSIA. This pressure level is representative of the fluid pressure at the compressor discharge pipe 16 including oil pressure at the final bearing in the compressor. This pressure can be read on the digital panel meter 83 by pressing the button 85. The pressure at the discharge of the compressor appearing as an analog on wire 48 is also delivered to a comparator 207 whose inverting input is connected to a voltage divider comprising the resistors 208 and 209. This voltage divider maintains a constant reference voltage on the inverting terminal of the comparator 207, and when the analog pressure signal appearing on wire 48 exceeds the reference potential from the voltage divider, a malfunction signal is delivered on the wire 210. The signal on wire 210 passes through the malfunction actuator gate 138 and actuates the malfunction control flipflop 103 to shut down the compressor. At the same time, the strobe circuit 136 strobes the latches, including the latch 211 which is connected with the output of the discharge pressure comparator 207, and when strobed this high signal appears at the output of the latch and is held in this condition until the system is reset. This signal passes through the OR gate 212 and lights the lamp 49 to indicate malfunction due to high discharge pressure, and at the same time the relay 214 is closed.

As stated briefly in connection with FIG. 1, oil pressure is measured both before and after the oil filter 25. The oil pressure measured after the filter 25 is determined by the pressure transducer 50 which puts out a differential signal to a signal conditioning circuit 216 which delivers an output through a low pass filter 217 and onto the wire 218, the signal on the wire 218 comprising an analog oil pressure signal whose level can be read by depressing the push button 88 to put the signal on the digital panel meter 83 as shown in FIG. 1. This analog oil pressure signal appearing on the wire 218 also includes the compressor pressure, the composite of the two signals reaching levels as high as 300 p.s.i. An analog signal representing this discharge pressure of the compressor appears on wire 48, and is subtracted in a differencing amplifier 219 so as to provide an output on wire 220 representing oil pressure per se. This oil pressure signal on wire 220 is then applied to an operational amplifier 221 whose other terminal is connected to a voltage divider including the resistors 223 and 224. This voltage divider applies a fixed reference potential to the operational amplifier 221 against which the oil pressure signal is compared. When the oil pressure signal falls below the reference level at the input to the operational amplifier 221, the system delivers a high output on the wire 225 which is connected to the malfunction actuator gate 138 and to a latch 226. When the malfunction gate is enabled by the output on wire 225, the strobe circuit 136 strobes the wire 127 and causes the latch to deliver an output through the OR gate 227 to light the oil pressure failure lamp 52. The output of the latch 226 also closes the relay 229. The oil pressure comprising composite pressure minus compressor discharge pressure can be read on the digital panel meter 83 by depressing the push button switch 86.

The oil pressure appearing before the oil filter is measured by the transducer 53, and its output delivers an oil pressure signal to the signal conditioning circuit 235 which is linearized and changed to a single ended output which is then delivered to a low pass filter 236. The signal appearing on the output wire 237 from the low pass filter comprises an analog pressure signal representing the oil pressure before the oil filter 25. A voltage divider comprising a potentiometer 238 delivers a portion of this signal to a comparator 239. The inverting input of the comparator receives the analog oil pressure signal on the wire 218 representing the oil pressure after the filter 25. Both the oil pressure analogs appearing on wires 218 and 237 include the discharge pressure of the compressor, and therefore they can be compared in the comparator 239 without further adjustment. When compared, if the difference in oil pressures is too great, an output on wire 240 appears and signals a clogged oil filter. The potentiometer 238 is adjusted so as to permit a certain differential pressure to develop in a partially clogged oil filter before an output appears on the wire 240. If the pressure differential for which the potentiometer 238 as adjusted should be exceeded, the oil filter is then clogged beyond a permissible degree, and the output on wire 240 passes through the OR gate 241 and lights the indicator lamp 55. It also closes the relay 242. No latch is placed in this circuit, and there is no connection to the malfunction OR gate 138, because the system need not be shut-down by a partially clogged oil filter. The degree of clogging permitted by the setting of the potentiometer 238 is selected so that the machine is not in danger of being damaged at the time when the lamp 55 becomes illuminated, and the operator can then take his time about shutting down the machine and replacing the oil filter.

The oil temperature in the vapor/oil separator tank 17 is measured by the transducer 57 which comprises a thermister circuit located within the vapor/oil separator tank 17 in FIG. 1. An analog level is delivered on wire 58 indicating the temperature of the oil in the separator, and this signal is applied to the inputs to a pair of comparators 245 and 246. The signal is applied to the inverting terminal of the comparator 245, and a voltage divider comprising the resistors 247 and 248 provides a reference voltage on the non-inverting terminal of the comparator. When the signal level on the wire 58 drops below this reference level, the comparator 245 delivers a high signal on the wire 249 to a latch 250. The signal on wire 249 is also delivered to the malfunction actuator gate 138 which shuts down the system and strobes the latch through the strobe circuit 136, whereby the latch 250 holds the malfunction indication and delivers a high signal through the OR gate 251 to light the lamp 59 indicating low oil temperature. The relay 252 is also actuated. Conversely, if the temperature of the oil as measured by the transducer 57 is too high, the higher level analog signal on the wire 58 will exceed a reference potential level applied by the resistors 253 and 254 to the inverting terminal of the comparator 246, thereby delivering an output on wire 255 indicating high oil temperature, this output being delivered to the malfunction OR gate 138 to shut down the system and strobe the latch 256, which then delivers a high signal through the OR gate 257 to light the high oil temperature lamp 60, the latch at the same time closing the relay 258. Thus, if the oil is either too hot or too cold, the compressor can be shut down. In the latter case, when a low oil temperature signal appears on the wire 58, the oil heater circuit 259 is enabled, thereby supplying current to the resistance heater 28 which is immersed in the oil within the separator tank 17.

Near the bottom of FIG. 4, there is a circuit for measuring the discharge temperature of the fluid coming from the compressor using the transducer 62 which comprises a thermister circuit located near the coupling flange at the output of the compressor 10 as shown in FIG. 1. This thermister delivers an analog signal representative of discharge temperature to one input of a comparator 263 whose inverting terminal is supplied with a reference potential taken from the voltage divider comprising the resistors 264 and 265. If the discharge temperature exceeds a preset level as determined by the reference potential applied to the inverting terminal of the comparator 263, a signal appears on the wire 266 which is delivered to the malfunction actuator gate 138 to shut down the compressor system, the output of the malfunction gate 138 actuating the strobe generator 136 to strobe the latches. At this time the input to the latch 267 will be high, and therefore the latch will retain a high output which it delivers through the OR gate 268 to light the high discharge temperature lamp 64, the latch also closing the relay 269. Finally, the compressor can be shut-down by a motor overload indication appearing on the wire 195. This indication comes from the circuit near the top of FIG. 3 which delivers an output on the wire 195 to indicate overloading of the main drive motor 13 which drives the compressor 10. The overload signal on wire 195 is applied through the malfunction actuator gate 138 which is repeated in FIG. 3, and then actuates the strobe circuit 136 to strobe the latch 270. The latch 270 therefore provides a high signal at its output terminal which passes through the OR gate 271 and lights the motor overload lamp 66. The output of the latch 270 also closes the relay 272.

As mentioned above, after the system is shut-down and the malfunction has been cleared, when the operator starts the system up again, he must first depress the reset button 40 shown in FIG. 2, whereupon the strobe circuit 136 is actuated through the OR gate 119, thereby strobing all of the latches which will then be reset to provide low outputs, whereby all of the indicator lamps will be extinguished.

The relays 202, 214, 229, 242, 252, 258, 269, and 272 are optional features of the circuit to provide convenient means for connection of other external monitoring circuitry to the system.

A second input is provided by wire 273 through each of the OR gates which immediately precedes the indicator lamps. These are the OR gates 201, 212, 227, 241, 251, 257, 268 and 271. When the operator presses the lamp test button 42 appearing on the front panel near the bottom of FIG. 1, all of the test lamps will be illuminated on the front panel so that the operativeness of these lamps can be easily demonstrated to the operator's satisfaction.

FIG. 5 shows a circuit which is included in the control system as currently manufactured and which can be connected to external equipment in order to monitor their parameters, and which can be used to indicate their malfunctions either with or without shutting down the present compressor system which this invention seeks to control. As can be seen at the bottom of FIG. 1, there are eight additional malfunction lamps labelled 93 through 100 inclusive. Three of the circuits for three of the control lamps are shown in FIG. 5, the other five being identical thereto, and consequently omitted from the figure for the sake of simplicity. The uppermost malfunction lamp system is typical, and includes a pair of terminals 274 into which a control signal can be delivered. These terminals are connected to a polarity reversing switch 275 which can be used to reverse the input terminals so that input signals of either polarity can be conveniently used for control purposes. The output of the polarity reversing switch is connected to a latch 276 which does not, until strobed, follow the signal at the output of the polarity reversing switch. This latch is strobed by the wire 127 in the same manner as the wire 127 strobes the other latches shown in FIG. 4. Therefore, if a malfunction occurs which shuts down the compressor system, the latches in FIG. 5 will be strobed so that the lamps connected thereto will retain a reading of their conditions until the system is reset after the malfunction has been cleared. It may or may not be desirable for any one of the external malfunction circuits of FIG. 5 to be able to shut down the compressor. In cases where a malfunction is being monitored which should result in shutting down of the compressor, the operator need only close the switch 277 which leads from the malfunction indicating wire to the latch. This puts a high signal on the shut-down wire 278, and this wire goes to the malfunction actuator gate 138 which is repeated in FIG. 5. Thus, when a signal passes from the wire 278 through the malfunction gate 138, the strobe circuit 136 strobes the wire 127 and thereby latches the condition of each external malfunction circuit, retaining the lighted indications on the malfunction lamps 93 through 100 inclusive even though the system is shutdown. The lamp test wire 273 puts a signal on all of the lamps 93 through 100 inclusive through the OR gates, such as the OR gates 279, 280 and 281. The wire 273 was discussed hereinbefore in connection with FIG. 4. The relays 282, 283 and 284 are optional devices which are closed whenever the associated latch is holding a high signal, and can be connected to external circuitry at the will of the operator. The other polarity reversing switches 282 and 284 as shown in FIG. 5, and the other latches 285 and 286 as shown in FIG. 5 function the same as the previously discussed latch and polarity reversing switch. If all of the switches such as the switches 277, 287 and 288 are closed, then a malfunction detected in any one of the circuits shown in FIG. 5 will also cause shutting down of the compressor. These external malfunction circuits may be connected to such signals as power line low voltage warning devices, fire in the building warning devices, or warning devices attached to other adjacent machinery.

With reference to the malfunction shut-down indicators, there could exist the possibility of two causes for shut-down; for example, high discharge temperature and high oil temperature could occur almost simultaneously. Only the first to occur will be indicated until the reset button 40 is pushed, the indication of the first one will disappear only if the first situation has been corrected; if the first situation has not been corrected then both the first and second lights will remain on.

Safety alarm indicator 41 will glow in a flashing sequence if the malfunction has caused compressor shut-down as indicated by signals on both wires 139 and 192, causing driver 191 to flash. When the malfunction has been corrected and the signal on wire 192 has been thereby eliminated, the alarm indicator light 41 will glow without any flashing. Pushing the reset button 40 will cause the malfunction control 103 to remove the signal on its Q output and turn off the indicator light 41, assuming that the malfunction has been cleared. Auxiliary alarm circuits which do not cause a compressor shut-down will cause only their own indicators to glow. Indicator light 41 will not glow in this case.

This invention is not to be limited to the exact illustrative embodiment shown in the drawings, for obviously changes can be made within the following claims.

We claim:

1. A control and monitoring system for connection with a fluid compressor driven by a motor and lubricated by an oil pump, the compressor including loading valve means operative to adjust the capacity of the compressor by modulating fluid leakage from its discharge toward its inlet to maintain a desired suction pressure at the inlet, said system comprising:

(a) system control means having an operate position operative to initiate a start-up and run sequence, and having an OFF position operative to stop the compressor drive motor and to initiate a shut-down and stop sequence;

(b) an oil pressure failure responsive circuit;

(c) a loading actuator and an unloading actuator, said actuators being connected to operate said loading valve means selectively and progressively to load or unload the compressor;

(d) first, second, and third delay means sequentially operative after the system control means is set to said operate position respectively to enable the pressure failure responsive circuit to check the oil pressure and reset the control means to OFF position in case of oil pressure failure, and operative to start the compressor drive motor, and operative thereafter to enable the compressor loading actuator; and (e) a shut-down timer initiated when the system control means is reset to OFF position to energize the unloading actuator for an interval long enough to move the loading valve means to an unloaded position.

2. The system as claimed in claim 1, including means initially enabled by setting of the system control means to operate position and subsequently disabled by the third delay means for energizing the unloading actuator, and means operative whenever the control means is reset for disabling the loading actuator.

3. The system as claimed in claim 1, including a starts-per-hour interval timer comprising a timer initiated by the system control means each time it turns ON the compressor drive motor, the timer having means connecting it with the system control means and preventing initiation of the start-up sequence until the starts-per-hour timer interval has expired, to prevent more than one start of the motor within the selected interval.

4. The system as claimed in claim 1, wherein the oil pump is connected with the compressor through an oil filter; means for measuring the differential oil pressure across the oil filter and delivering an analog representative thereof; means for establishing a reference voltage; means for comparing the analog with said reference voltage; and indicator means operative to indicate a clogged filter when the analog exceeds the reference voltage.

5. The system as claimed in claim 1, including a malfunction control having a set position indicating a malfunction and connected to reset the system control means to OFF position and having a reset position which is connected to enable the system control means to be set into operate position; and malfunction actuator means operative to set the malfunction control when actuated, the oil pressure failure responsive circuit being connected to actuate the malfunction actuator means in the event of oil pressure failure.

6. The system as claimed in claim 5, including an alarm lamp for indicating when the system is shut-down by a malfunction, an alarm lamp driver having a flashing mode and a nonflashing steady illumination mode, the driver having one input connected to sense the set position of said malfunction control and having another input connected to sense output from said malfunction actuator, the driver being in the flashing mode when both inputs are present, and in the steady mode when output from the malfunction actuator ceases.

7. The system as claimed in claim 5, including means for measuring oil and fluid temperatures and delivering analogs representative thereof; means for measuring compressor suction and discharge pressures and delivering analogs representative thereof, means for measuring oil pressures and compressor drive motor loading and delivering analogs representative thereof; means for establishing reference voltages respectively for each of said measured analogs; and means for comparing the analogs with their respective reference voltages and operative to deliver a malfunction signal to actuate said malfunction control actuator.

8. The system as claimed in claim 7, including a meter for reading the level of said analogs, and switch means for selectively connecting the meter to any one of said analogs.

9. The system as claimed in claim 7, including an indicator lamp for each comparing means; a latch circuit coupling each comparing means with the corresponding indicator lamp, said latches being responsive to a strobe signal to latch and retain the outputs of the comparing means and show the presence of malfunction signals when strobed, and the malfunction actuator means including means for delivering a strobe signal to said latches when setting the malfunction control in response to a malfunction signal.

10. The system as claimed in claim 9, including circuit means actuated by a momentary switch and operative to light all of the indicator lamps to test their operability.

11. The system as claimed in claim 9, including a relay attached to each latch and operative to close when the latch is holding a malfunction signal, the relays being connectable to a remote monitoring location.

12. The system as claimed in claim 9, further including external malfunction means comprising multiple input circuit means each connectable to monitor a function external to the compressor and its drive; a latch connected to each input circuit means; an indicator connected to each latch, said latches being responsive to a strobe signal from the malfunction actuator to retain an indication of the external functions monitored; and switch means connected between each input circuit means and the malfunction actuator means and selectively closable to operate the malfunction actuator means when the selected input circuit means responds to a malfunction of the monitored functions.

13. The system as claimed in claim 9, including reset means operative when actuated to reset the malfunction control circuit, the reset means including means to strobe again said latches.

14. The system as claimed in claim 1, including means in the compressor inlet for measuring fluid suction pressure; means adjustable to select a compressor loading setpoint comprising a reference suction pressure; suction pressure comparator means for comparing said measured suction pressure with said reference suction pressure, said comparator means having separate outputs including a first output whose amplitude represents the degree of deviation from the setpoint when the suction pressure is greater than the reference suction pressure and including a second output whose amplitude represents the degree of deviation from the setpoint when the suction pressure is less than the reference suction pressure; and means for converting the first and second outputs when present, respectively, to first and second control signals comprising trains of pulses whose duty cycles vary according to the amplitudes of said respective outputs, and said control signals being coupled respectively to said loading and unloading actuators and operative to control said actuators to load or unload the compressor in increments proportional to the durations of said pulses.

15. The system as claimed in claim 14, wherein said means for converting said first and second outputs comprises separate comparators each having one input connected to one of said outputs; a triangular wave generator connected to the other input of each comparator, one comparator delivering an output control signal pulse which is present whenever one of said inputs exceeds the momentary level of the triangular wave, and the other comparator delivering an output control pulse whenever the other of said inputs exceeds the momentary level of the triangular wave; and means to establish a threshold level at the inputs to said comparators to provide a deadband within which said first and second outputs are too small to provide output control signals from the comparators.

16. The system as claimed in claim 14, wherein the compressor is driven by an electric motor, means for measuring the motor current; means adjustable to select a motor loading setpoint comprising a motor current reference; and motor load comparator means for comparing said measured motor current with said motor current reference and delivering control signals in response to the measured motor load approaching the setpoint, said control signals being connected to inhibit said compressor loading actuator.

17. The system as claimed in claim 16, wherein the motor load comparator means includes a comparator operative to deliver a further control signal in response to the measured motor load exceeding the setpoint, and said further control signal being connected to actuate said unloading actuator.

18. The system as claimed in claim 16, including a meter; switching means for selectively connecting the meter to read the present value of any one of the group of levels including suction pressure, setpoint reference suction pressure, motor current and setpoint current reference.

* * * * *